US009495909B2

(12) United States Patent
Tani et al.

(10) Patent No.: US 9,495,909 B2
(45) Date of Patent: Nov. 15, 2016

(54) ORGANIC LIGHT EMITTING DISPLAY

(71) Applicant: LG DISPLAY CO., LTD, Seoul (KR)

(72) Inventors: Ryosuke Tani, Paju-si (KR); Sungjin Hong, Goyang-si (KR); Woojin Nam, Goyang-si (KR); Joonmin Park, Paju-si (KR); Seonmi Lee, Hanam-si (KR); Inyoung Yang, Seoul (KR); Jongho Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 191 days.

(21) Appl. No.: 14/533,937

(22) Filed: Nov. 5, 2014

(65) Prior Publication Data

US 2015/0187268 A1 Jul. 2, 2015

(30) Foreign Application Priority Data

Dec. 30, 2013 (KR) ..... 10-2013-0166678

(51) Int. Cl.
*G09G 3/30* (2006.01)
*G09G 3/32* (2016.01)

(52) U.S. Cl.
CPC ..... *G09G 3/3233* (2013.01); *G09G 3/3291* (2013.01); *G09G 2310/0254* (2013.01); *G09G 2320/0233* (2013.01); *G09G 2320/0295* (2013.01); *G09G 2320/043* (2013.01); *G09G 2320/045* (2013.01)

(58) Field of Classification Search
CPC ..... G09G 2300/0861; G09G 2310/0251; G09G 2310/061; G09G 2320/32333
USPC ..... 345/76, 211–212, 690–691
See application file for complete search history.

(56) References Cited

U.S. PATENT DOCUMENTS

2008/0036712 A1* 2/2008 Chung ..... G09G 3/3266 345/82
2009/0140959 A1* 6/2009 Nam ..... G09G 3/3233 345/76
2010/0085282 A1* 4/2010 Yu ..... G09G 3/3233 345/76

* cited by examiner

*Primary Examiner* — Calvin C Ma
(74) *Attorney, Agent, or Firm* — Dentons US LLP

(57) ABSTRACT

An organic light emitting display includes a display panel including display lines, on which a plurality of pixels each including an organic light emitting diode and a driving thin film transistor (TFT) are formed. The display lines are sequentially charged to an image display data voltage in response to an image display gate pulse in an image display period of one frame. A sensing target display line among the display lines outputs a sensing voltage corresponding to changes in electrical characteristic of the driving TFT included in each pixel in response to a sensing gate pulse during a vertical blank period excluding the image display period from the one frame and then is charged to a luminance recovery data voltage. The sensing gate pulse is supplied in the same pulse shape as the image display gate pulse in a predetermined period for charging the luminance recovery data voltage.

13 Claims, 13 Drawing Sheets

ORGANIC LIGHT EMITTING DISPLAY

This application claims the benefit of Korea Patent Application No. 10-2013-0166678 filed on Dec. 30, 2013, which is incorporated herein by reference for all purposes as if fully set forth herein.

BACKGROUND OF THE INVENTION

1. Field of the Invention

Embodiments of the invention relate to an active matrix organic light emitting display.

2. Discussion of the Related Art

An active matrix organic light emitting display includes organic light emitting diodes ("OLEDs") capable of emitting light by itself and has advantages of a fast response time, a high light emitting efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

The organic light emitting display arranges pixels each including the OLED in a matrix form and adjusts a luminance of the pixels depending on a gray scale of video data. Each pixel includes a driving thin film transistor (TFT) for controlling a driving current flowing in the OLED. There occurs a deviation in electrical characteristics (including a threshold voltage, a mobility factor, etc.) of the driving TFT of each pixel because of a process deviation, etc. of the organic light emitting display. Hence, the pixels have different currents (i.e., different emission amounts of the OLED) with respect to the same data voltage. As a result, the organic light emitting display has a luminance deviation.

To solve the luminance deviation, an external compensation method is known to sense changes in a characteristic parameter (for example, a threshold voltage and a mobility) of the driving TFT of each pixel and to properly correct input data depending on the sensing result. The external compensation method reduces the luminance non-uniformity resulting from changes in the electrical characteristic of the driving TFT.

The electrical characteristic of the driving TFT continuously changes during a drive of the driving TFT. Thus, it is preferable to compensate for the changes in the electrical characteristic of the driving TFT in real time for an increase in a compensation performance. FIG. 1 shows a related art RT (real-time) compensation technology compensating for changes in the electrical characteristic of the driving TFT in real time using the external compensation method. As shown in FIG. 1, the related art RT compensation technology performs a sensing operation in a vertical blank period VB excluding an image display period DP from an image frame. Namely, the related art RT compensation technology senses only one display line in the vertical blank period VB of each image frame. First pixels of a display line, on which the RT sensing is not performed, maintain an emission state resulting from image display data during one image frame including the vertical blank period VB. However, second pixels of a display line, on which the RT sensing is performed, stop the emission resulting from the image display data in the vertical blank period VB, so as to perform the sensing operation. When the sensing operation is completed, luminance recovery data of the same voltage level as the image display data is input to the second pixels. The second pixels maintain an emission state resulting from the luminance recovery data during a remaining period excluding the vertical blank period VB from the one image frame.

In pixels of the display line, on which the RT sensing is performed, an emission duty resulting from the image display data in one image frame has a maximum value in one side (for example, an upper part of a display panel in FIG. 1) of the display panel, to which data is firstly applied, and gradually decreases as the display line goes from the one side of the display panel to the other side (for example, a lower part of the display panel in FIG. 1) of the display panel, to which the data is last applied. On the contrary, in the pixels of the display line, on which the RT sensing is performed, an emission duty resulting from the luminance recovery data in one image frame has a minimum value in one side (for example, the upper part of the display panel in FIG. 1) of the display panel and gradually increases as the display line goes from the one side of the display panel to the other side (for example, the lower part of the display panel in FIG. 1) of the display panel.

However, even when the image display data and the luminance recovery data are applied at the same voltage level, luminances of the image display data and the luminance recovery data represented for the same period of time are different from each other. A reason to generate such a luminance deviation is because gate signals for applying the image display data and the luminance recovery data to the pixel are different from each other. Further, the reason is because an initialization state of a source node of the driving TFT for programming the image display data is different from an initialization state of the source node of the driving TFT for programming the luminance recovery data.

As described above, when the luminance represented by the image display data is different from the luminance represented by the luminance recovery data, there occurs a luminance deviation between a display line, on which the RT sensing is performed, and display lines, on which the RT sensing is not performed, during the same image frame. Namely, as shown in FIG. 2, a luminance of one display line, on which the RT sensing is performed, may be greater or less than a luminance of one display line, on which the RT sensing is not performed.

The luminance deviation varies depending on a display location of the display line, on which the RT sensing is performed. When the display line, on which the RT sensing is performed, is positioned at the upper part of the display panel, a length of an emission period of the luminance recovery data is short. Hence, the luminance deviation is relatively small. However, as the display line, on which the RT sensing is performed, approaches the lower part of the display panel, the length of the emission period of the luminance recovery data increases. Hence, the luminance deviation gradually increases.

SUMMARY OF THE INVENTION

Embodiments of the invention provide an organic light emitting display capable of minimizing a luminance deviation between a display line, on which real-time sensing is performed, and a display line, on which the real-time sensing is not performed, when changes in electrical characteristic of a driving thin film transistor (TFT) are compensated in real time using an external compensation method.

In one aspect, there is an organic light emitting display comprising a display panel including display lines, on which a plurality of pixels each including an organic light emitting diode and a driving thin film transistor (TFT) are formed, the display lines being sequentially charged to an image display data voltage in response to an image display gate pulse in an image display period of one frame, a sensing target display line among the display lines outputting a sensing voltage corresponding to changes in electrical characteristic of the driving TFT included in each pixel in response to a sensing gate pulse during a vertical blank period excluding the image display period from the one frame and then being charged to a luminance recovery data voltage, a gate driving circuit configured to sequentially supply the image display gate pulse to gate lines connected to the pixels of the display lines during the image display period and supply the sensing gate pulse to a gate line connected to the pixels of the sensing target display line during the vertical blank period, and a data driving circuit configured to supply the image display data voltage to data voltage supply lines connected to the pixels of the display lines in synchronization with the image display gate pulse and supply the luminance recovery data voltage to data voltage supply lines connected to the pixels of the sensing target display line in synchronization with the sensing gate pulse, wherein the sensing gate pulse is supplied in the same pulse shape as the image display gate pulse in a predetermined period for charging the luminance recovery data voltage.

Each pixel includes the driving TFT including a gate electrode connected to a first node, a source electrode connected to a second node, and a drain electrode connected to an input terminal of a high potential driving voltage, the organic light emitting diode connected between the second node and an input terminal of a low potential driving voltage, a storage capacitor connected between the first node and the second node, a first switch TFT connected between one of the data voltage supply lines and the first node, and a second switch TFT connected between a reference line, to which the sensing voltage is output, and the second node.

The image display gate pulse includes a first image display gate pulse for turning on the first switch TFT in the image display period and a second image display gate pulse for turning on the second switch TFT in the image display period. The sensing gate pulse includes a first sensing gate pulse for turning on the first switch TFT in the vertical blank period and a second sensing gate pulse for turning on the second switch TFT in the vertical blank period.

The image display period includes an image display initialization period, in which a source voltage of the driving TFT is initialized to a previously determined reference voltage in response to the first image display gate pulse of an off-level and the second image display gate pulse of an on-level, an image display programming period, in which the image display data voltage is applied to the gate electrode of the driving TFT in response to the first and second image display gate pulses of the on-level in the initialization state of the source voltage of the driving TFT and turns on the driving TFT, and an image display emission period, in which the organic light emitting diode operates using an image display driving current applied through the driving TFT in response to the first and second image display gate pulses of the off-level and displays an original image.

The vertical blank period includes a sensing initialization period, in which a source voltage of the driving TFT is firstly initialized to a first reference voltage, which is previously determined, in response to the first sensing gate pulse of an off-level and the second sensing gate pulse of an on-level, a sensing programming period, in which a sensing data voltage is applied to the gate electrode of the driving TFT in response to the first and second sensing gate pulses of the on-level in the first initialization state of the source voltage of the driving TFT and sets the driving TFT to a turn-on state, a sensing period, in which the source voltage of the driving TFT increased by a current flowing in the driving TFT is sensed and stored in response to the first sensing gate pulse of the off-level and the second sensing gate pulse of the on-level, a sampling period, in which the sensed source voltage of the driving TFT is sampled and detected as the changes in the electrical characteristic of the driving TFT in response to the first and second sensing gate pulses of the on-level, a luminance recovery initialization period, in which the source voltage of the driving TFT is secondly initialized to a second reference voltage in response to the first sensing gate pulse of the off-level and the second sensing gate pulse of the on-level, a luminance recovery programming period, in which the luminance recovery data voltage is applied to the gate electrode of the driving TFT in response to the first and second sensing gate pulses of the on-level in the second initialization state of the source voltage of the driving TFT and turns on the driving TFT, and a luminance recovery emission period, in which the organic light emitting diode operates using a luminance recovery driving current applied through the driving TFT in response to the first and second sensing gate pulses of the off-level and displays a luminance recovery image.

During the luminance recovery initialization period, the first sensing gate pulse is maintained at the off-level, and the second sensing gate pulse is maintained at the off-level and then is changed to the on-level.

The first reference voltage is less than the second reference voltage.

A black display data voltage capable of turning off the driving TFT is applied to the gate electrode of the driving TFT during the sampling period.

The luminance recovery data voltage has the same voltage level as the image display data voltage applied to the sensing target display line during the image display period.

The organic light emitting display further comprises a timing controller configured to control an operation of the gate driving circuit and an operation of the data driving circuit, modulate image display digital data to be applied to the display lines during the image display period to compensate for the changes in the electrical characteristic of the driving TFT, and modulate luminance recovery digital data to be applied to the sensing target display line during the vertical blank period to compensate for a luminance deviation between the sensing target display line and another display line. The image display digital data corresponds to the image display data voltage, and the luminance recovery digital data corresponds to the luminance recovery data voltage.

A compensation value for modulating the luminance recovery digital data varies depending on a location of the sensing target display line.

The compensation value for modulating the luminance recovery digital data gradually decreases as the sensing target display line goes from one side of the display panel, to which data is firstly applied, to the other side of the display panel, to which the data is last applied.

The change in the electrical characteristic of the driving TFT indicates at least one of change in a threshold voltage of the driving TFT and change in a mobility of the driving TFT.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 3 to 13.

Figure 1:
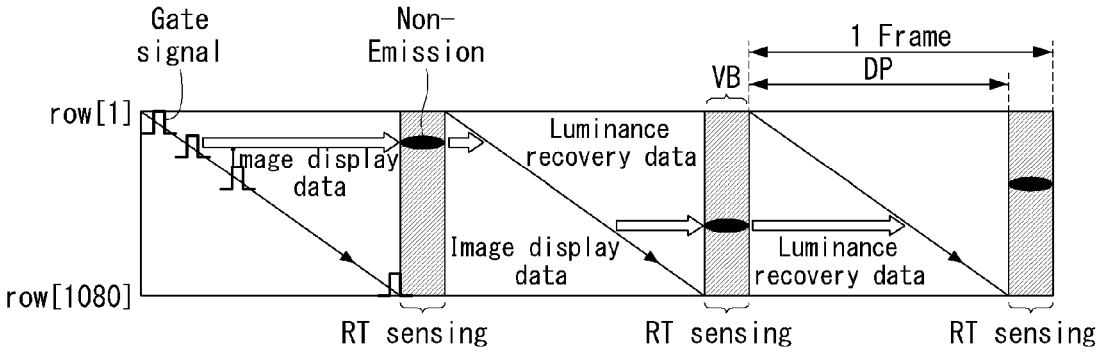
FIG. 1 (RELATED ART)
FIG. 1 illustrates a related art RT (real-time) compensation technology, in which RT sensing is performed in a vertical blank period.
Figure 2:
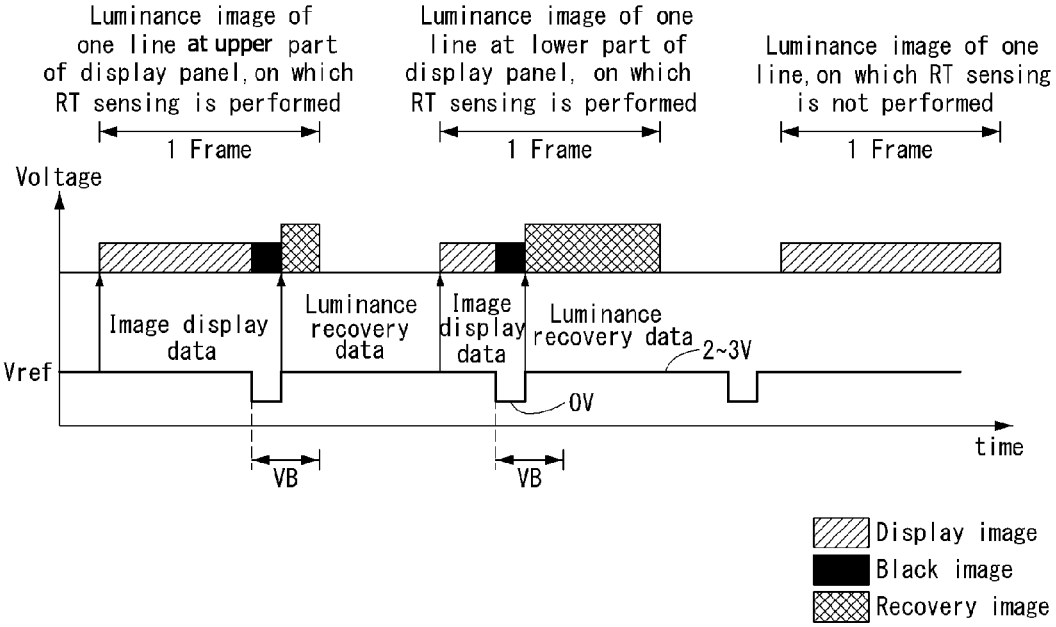
FIG. 2 (RELATED ART)
FIG. 2 illustrates a principle, in which a line dim generated by a luminance deviation is visible in a related art RT compensation technology.
Figure 3:
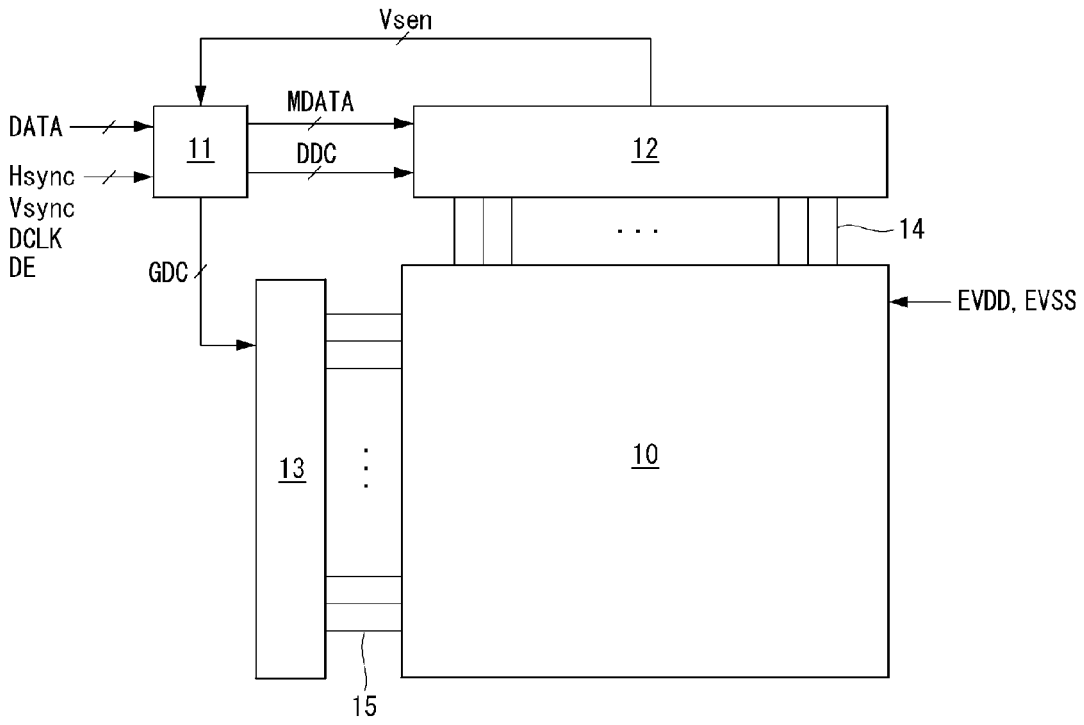
FIG. 3 is a block diagram of an organic light emitting display according to an exemplary embodiment of the invention.
Figure 4:
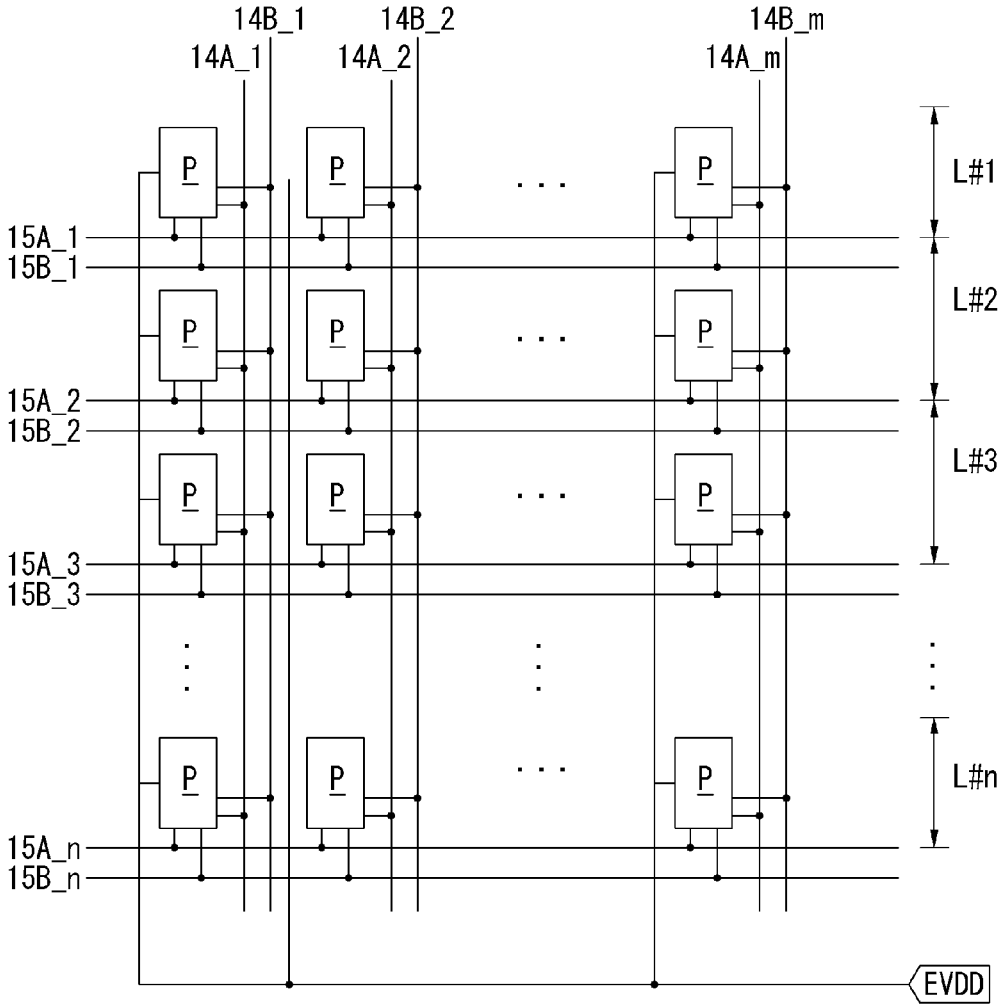
FIG. 4 shows a pixel array of a display panel shown in FIG. 3.
Figure 5:
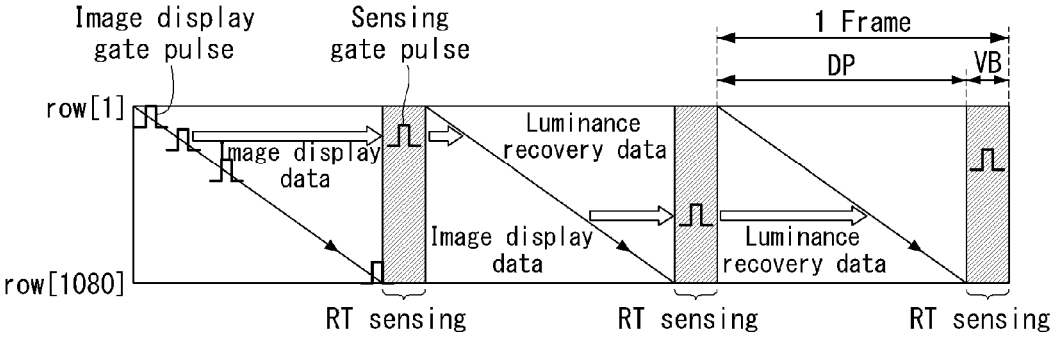
FIG. 5 illustrates an RT compensation technology according to an exemplary embodiment of the invention, in which RT sensing is performed in a vertical blank period.

FIG. 3 is a block diagram of an organic light emitting display according to an exemplary embodiment of the invention. FIG. 4 shows a pixel array of a display panel shown in FIG. 3. FIG. 5 illustrates an RT (real-time) compensation technology according to the embodiment of the invention, in which RT sensing is performed in a vertical blank period.

As shown in FIGS. 3 and 4, the organic light emitting display according to the embodiment of the invention includes a display panel 10, a timing controller 11, a data driving circuit 12, and a gate driving circuit 13.

The display panel 10 includes a plurality of data lines 14, a plurality of gate lines 15 crossing the data lines 14, and a plurality of pixels P respectively arranged at crossings of the data lines 14 and the gate lines 15 in a matrix form. The data lines 14 include m data voltage supply lines 14A_1 to 14A_m and m reference lines 14B_1 to 14B_m, where m is a positive integer. The gate lines 15 include n first gate lines 15A_1 to 15A_n and n second gate lines 15B_1 to 15B_n, where n is a positive integer.

Each pixel P receives a high potential driving voltage EVDD and a low potential driving voltage EVSS from a power generator (not shown). Each pixel P according to the embodiment of the invention may include an organic light emitting diode (OLED), a driving thin film transistor (TFT), first and second switch TFTs, and a storage capacitor for the external compensation. The TFTs constituting the pixel P may be implemented as a p-type transistor or an n-type transistor. Further, semiconductor layers of the TFTs constituting the pixel P may contain amorphous silicon, polycrystalline silicon, or oxide.

Each pixel P is connected to one of the data voltage supply lines 14A_1 to 14A_m, one of the reference lines 14B_1 to 14B_m, one of the first gate lines 15A_1 to 15A_n, and one of the second gate lines 15B_1 to 15B_n.

As illustrated in FIG. 4, the display panel 10 includes a plurality of display lines L#1 to L#n implementing an image through the plurality of pixels P. As shown in FIG. 5, the display lines L#1 to L#n are sequentially charged to an image display data voltage in response to an image display gate pulse in an image display period DP of one frame. A sensing target display line among the display lines outputs a sensing voltage Vsen corresponding to changes in electrical characteristic of the driving TFT included in each pixel P in response to a sensing gate pulse during a vertical blank period VB excluding the image display period DP from the one frame and then is charged to a luminance recovery data voltage. RT (real-time) sensing is performed on the sensing target display line in the vertical blank period VB. In the embodiment disclosed herein, the sensing target display line is selected as one display line in each frame and may be sequentially selected among the display lines along one direction (for example, a direction based on data refresh order, namely, a data scan direction). Alternatively, the sensing target display line may be non-sequentially selected among the display lines irrespective of the one direction. Further, the change in the electrical characteristic of the driving TFT indicates at least one of change in a threshold voltage of the driving TFT and change in a mobility of the driving TFT.

The gate driving circuit 13 may be implemented as an integrated circuit (IC) or may be directly formed on the display panel 10 through a gate driver-in panel (GIP) process. The gate driving circuit 13 sequentially supplies the image display gate pulse to the gate lines 15 connected to the pixels of the display lines L#1 to L#n in response to a gate control signal GDC received from the timing controller 11 during the image display period DP. The gate driving circuit 13 supplies the sensing gate pulse to the gate line 15 connected to the pixels of the sensing target display line in response to the gate control signal GDC during the vertical blank period VB.

The image display gate pulse includes a first image display gate pulse sequentially supplied to the first gate lines 15A_1 to 15A_n and a second image display gate pulse sequentially supplied to the second gate lines 15B_1 to 15B_n. The sensing gate pulse includes a first sensing gate pulse supplied to one first gate line connected to the sensing target display line among the first gate lines 15A_1 to 15A_n and a second sensing gate pulse supplied to one second gate line connected to the sensing target display line among the second gate lines 15B_1 to 15B_n.

An entire pulse shape and a pulse width of the sensing gate pulse may be different from those of the image display gate pulse. However, the sensing gate pulse is supplied in the same pulse shape as the image display gate pulse in a predetermined period for charging the luminance recovery data voltage.

The data driving circuit 12 supplies data voltages required in a drive to the data voltage supply lines 14A_1 to 14A_m, supplies a reference voltage to the reference lines 14B_1 to 14B_m, and performs digital processing on a sensing voltage received through the reference lines 14B_1 to 14B_m to supply the digital sensing voltage to the timing controller 11 in response to a data control signal DDC received from the timing controller 11. The data voltages required in the drive include an image display data voltage, a sensing data voltage, a black display data voltage, a luminance recovery data voltage, and the like.

The data driving circuit 12 supplies the image display data voltage to the data lines connected to the pixels of the display lines L#1 to L#n in synchronization with the image display gate pulse and supplies the sensing data voltage, the black display data voltage, and the luminance recovery data voltage to the data lines connected to the pixels of the sensing target display line in synchronization with the sensing gate pulse. The image display data voltage indicates a data voltage, in which a compensation value for compensating for the changes in the electrical characteristic of the driving TFT is reflected. The sensing data voltage indicates a data voltage applied to a gate electrode of the driving TFT, so as to turn on the driving TFT of each of the pixels of the sensing target display line. The black display data voltage indicates a data voltage applied to the gate electrode of the driving TFT, so as to turn off the driving TFT of each of the pixels of the sensing target display line. The luminance recovery data voltage indicates a data voltage used to recover a luminance of the sensing target display line to an image display level immediately before the RT sensing and is selected at the same voltage level as the image display data voltage applied to the sensing target display line in the image display period DP immediately before the RT sensing.

The timing controller 11 generates the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. The timing controller 11 modulates image display digital data to be applied to the display lines L#1 to L#n during the image display period DP, so as to compensate for the changes in the electrical characteristic of the driving TFT based on the sensing voltage Vsen supplied from the data driving circuit 12. Further, the timing controller 11 modulates luminance recovery digital data to be applied to the sensing target display line during the vertical blank period VB, so as to compensate for a luminance deviation between the sensing target display line and other display line. In FIG. 3, "MDATA" indicates the image display digital data and the luminance recovery digital data, each of which is modulated and output by the timing controller 11. The image display digital data indicates data, which is converted into the image display data voltage by the data driving circuit 12. Further, the luminance recovery digital data indicates data, which is converted into the luminance recovery data voltage by the data driving circuit 12.

Figure 6:
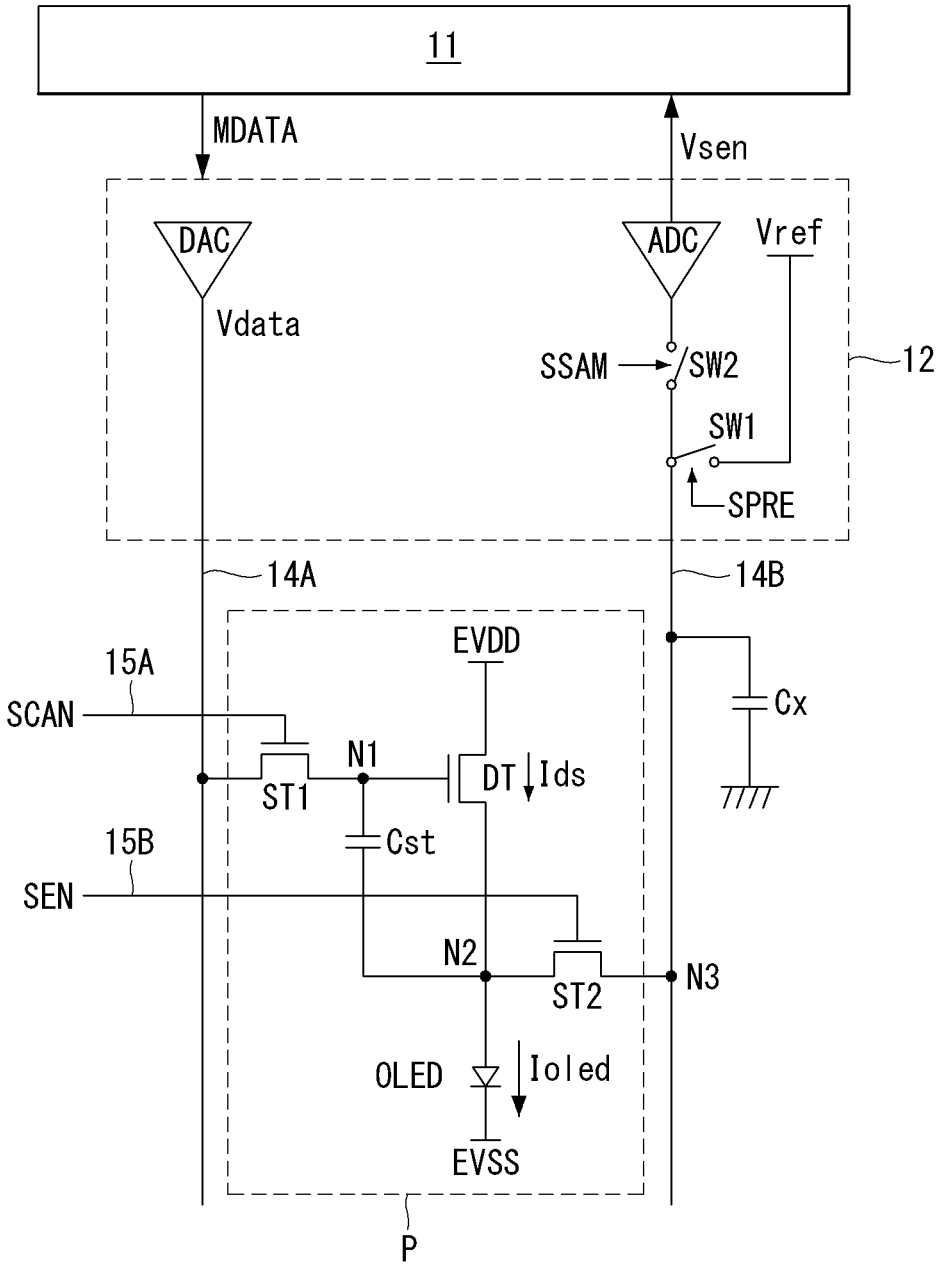
FIG. 6 illustrates a connection structure between a timing controller, a data driving circuit, and pixels along with a detailed configuration of an external compensation pixel.

FIG. 6 illustrates a connection structure between the timing controller 11, the data driving circuit 12, and the pixels P along with a detailed configuration of an external compensation pixel. In FIG. 6, a first gate pulse SCAN may include a first image display gate pulse during the image display period DP and a first sensing gate pulse during the vertical blank period VB corresponding to a non-display period. A second gate pulse SEN may include a second image display gate pulse during the image display period DP and a second sensing gate pulse during the vertical blank period VB. Further, in FIG. 6, a data voltage Vdata may include the image display data voltage during the image display period DP and the sensing data voltage, the black display data voltage, and the luminance recovery data voltage during the vertical blank period VB.

As shown in FIG. 6, the pixel P capable of compensating for changes in the electrical characteristics of the driving TFT in real time using an external compensation method according to the embodiment of the invention includes an OLED, a driving TFT DT, a storage capacitor Cst, a first switch TFT ST1, and a second switch TFT ST2.

The OLED includes an anode electrode connected to a second node N2, a cathode electrode connected to an input terminal of the low potential driving voltage EVSS, and an organic compound layer positioned between the anode electrode and the cathode electrode.

The driving TFT DT includes a gate electrode connected to a first node N1, a drain electrode connected to an input terminal of the high potential driving voltage EVDD, and a source electrode connected to the second node N2. The driving TFT DT controls a driving current holed flowing in the OLED depending on a gate-source voltage Vgs of the driving TFT DT. The driving TFT DT is turned on when the gate-source voltage Vgs is greater than a threshold voltage Vth. As the gate-source voltage Vgs increases, a current Ids flowing between the source electrode and the drain electrode of the driving TFT DT increases. When a source voltage of the driving TFT DT is greater than a threshold voltage of the OLED, the source-drain current Ids of the driving TFT DT, as the driving current Ioled, flows through the OLED. As the driving current Ioled increases, an emission amount of the OLED increases. Hence, a descried gray scale is represented.

The storage capacitor Cst is connected between the first node N1 and the second node N2.

The first switch TFT ST1 includes a gate electrode connected to the first gate line 15A, a drain electrode connected to the data voltage supply line 14A, and a source electrode connected to the first node N1. The first switch TFT ST1 is turned on in response to the first gate pulse SCAN and applies the data voltage Vdata charged to the data voltage supply line 14A to the first node N1.

The second switch TFT ST2 includes a gate electrode connected to the second gate line 15B, a drain electrode connected to the second node N2, and a source electrode connected to the reference line 14B. The second switch TFT ST2 is turned on in response to the second gate pulse SEN and electrically connects the second node N2 to the reference line 14B.

The data driving circuit 12 is connected to the pixel P through the data voltage supply line 14A and the reference line 14B. A sensing capacitor Cx for storing a source voltage of the second node N2 as the sensing voltage Vsen may be formed on the reference line 14B. The data driving circuit 12 includes a digital-to-analog converter (DAC), an analog-to-digital converter (ADC), an initialization switch SW1, a sampling switch SW2, and the like.

The DAC generates the data voltages required in the drive, i.e., the image display data voltage, the sensing data voltage, the black display data voltage, and the luminance recovery data voltage and outputs the data voltages to the data voltage supply line 14A. The initialization switch SW1 is turned on in response to an initialization control signal SPRE and outputs a reference voltage Vref to the reference line 14B. The sampling switch SW2 is turned on in response to a sampling control signal SSAM and supplies a source voltage of the driving TFT DT, which is stored in the sensing capacitor Cx of the reference line 14B for a predetermined period of time, as the sensing voltage, to the ADC. The ADC converts an analog sensing voltage stored in the sensing capacitor Cx into the digital sensing voltage Vsen Vsen and supplies the digital sensing voltage Vsen to the timing controller 11.

In such a structure of the pixel P, pixel luminances represented by image display data and luminance recovery data of the same voltage level are different from each other.

Figure 7:
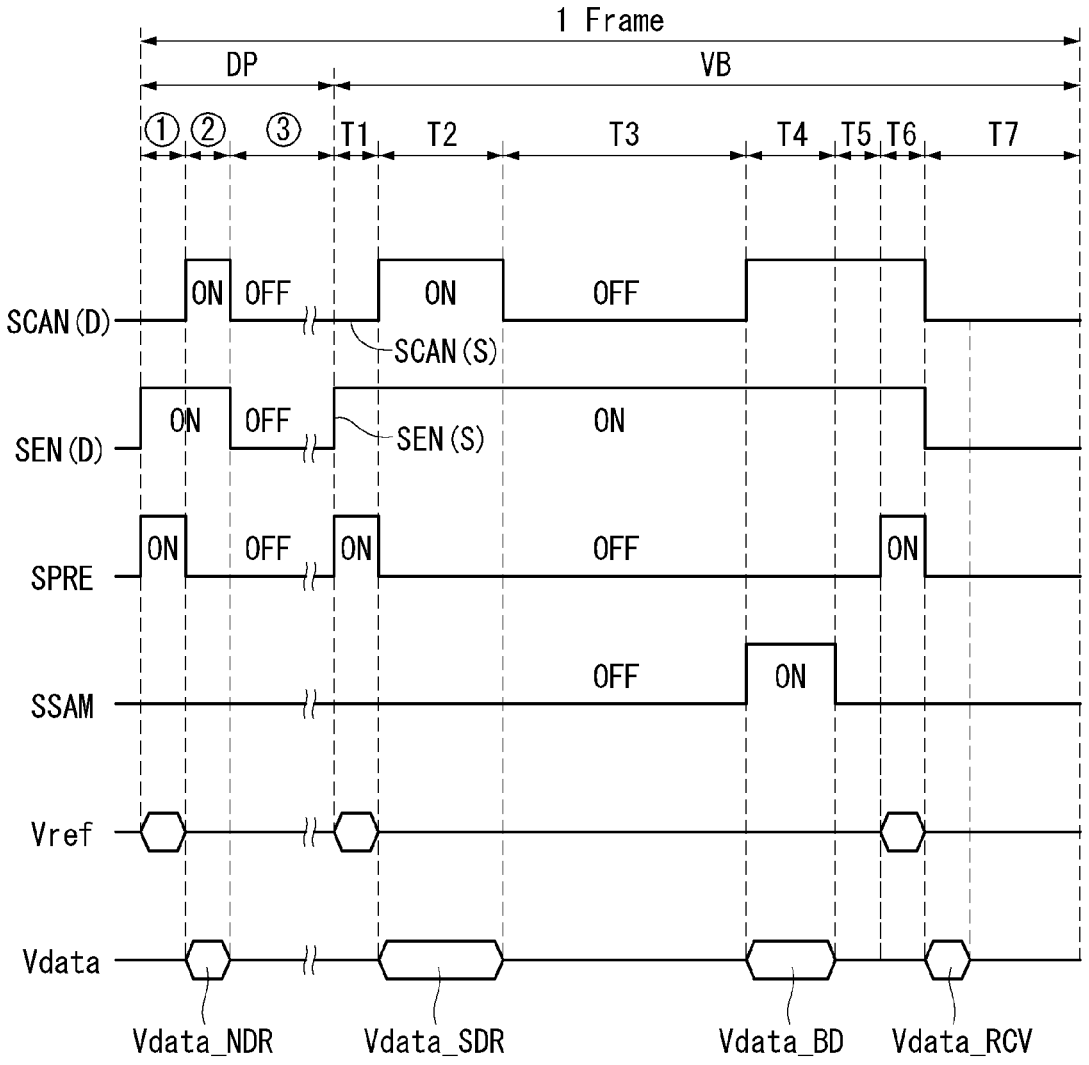
FIG. 7 and FIG. 8A illustrate a reason of the generation of a luminance deviation.
Figure 8A:
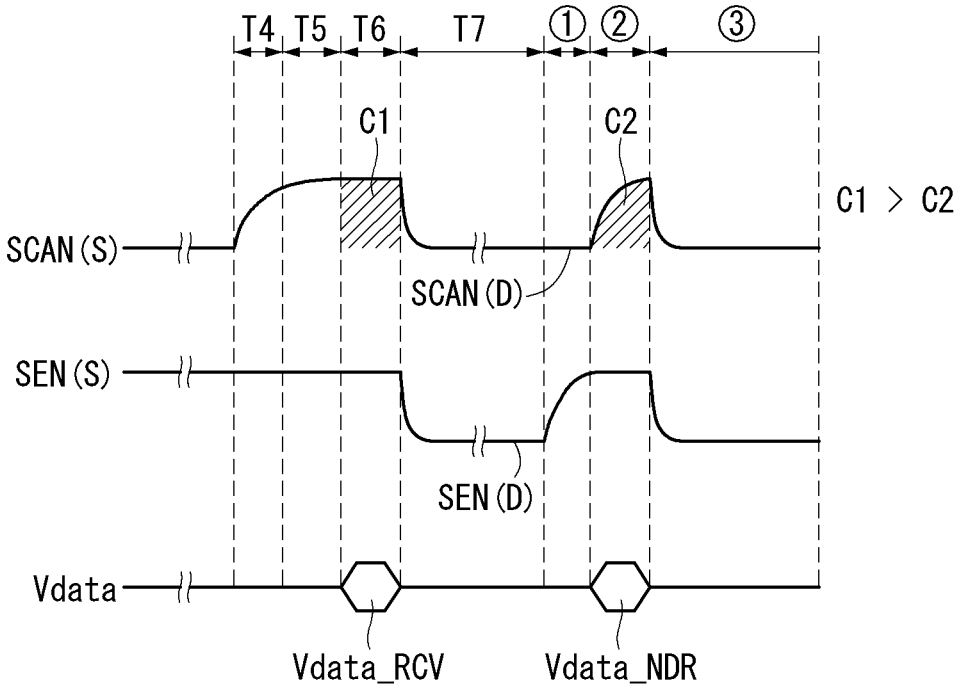

FIG. 7 and FIG. 8A illustrate a reason of the generation of a luminance deviation.

More specifically, FIG. 7 shows an image display driving process for implementing an original image in the image display period DP and a sensing driving process for sensing changes in the electrical characteristic of the driving TFT and implementing the same luminance recovery image as the original image in the vertical blank period VB. The image display driving process may be performed through an image display initialization period ①, an image display programming period ②, and an image display emission period ③. The sensing driving process may be performed through a sensing initialization period T1, a sensing programming period T2, a sensing period T3, a sampling period T4, a luminance recovery initialization period T5, a luminance recovery programming period T6, and a luminance recovery emission period T7.

Figure 8B:
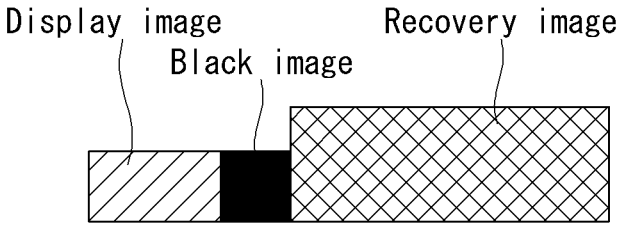
FIG. 8B shows an example of a luminance deviation between a display image and a recovery image.

A reason why the luminance deviation is generated between the image display data voltage and the luminance recovery data voltage of the same voltage level is because the image display gate pulse and the sensing gate pulse have different shapes in the initialization period and the programming period. More specifically, shapes of image display gate pulses SCAN(D) and SEN(D) corresponding to the image display initialization period ① and the image display programming period ② are different from shapes of sensing gate pulses SCAN(S) and SEN(S) corresponding to the luminance recovery initialization period T5 and the luminance recovery programming period T6. The difference of the pulse shape generates a charge deviation shown in FIG. 8A. Even if the pulse shapes in the image display programming period ② and the luminance recovery programming period T6 are equally set, a saturation maintenance width of the first sensing gate pulse SCAN(S) may be greater than a saturation maintenance width of the first image display gate pulse SCAN(D). Therefore, a charge amount C1 of a luminance recovery data voltage Vdata_RCV charged to the gate electrode of the driving TFT during the luminance recovery programming period T6 may be more than a charge amount C2 of an image display data voltage Vdata_NDR charged to the gate electrode of the driving TFT during the image display programming period ②. Thus, as shown in FIG. 8B, a luminance amount of a recovery image resulting from the luminance recovery data voltage Vdata_RCV having the relatively large charge amount is more than a luminance amount of a display image resulting from the image display data voltage Vdata_NDR having the relatively small charge amount.

As described above, when the luminance amount of the recovery image is different from the luminance amount of the display image, the luminance deviation is generated between the sensing target display line, on which the RT sensing is performed, and the non-sensing target display line, on which the RT sensing is not performed, during the same image frame. The luminance deviation varies depending on a display location of the sensing target display line. As the sensing target display line approaches the lower part of the display panel, in which a display duty of the recovery image gradually increases, the luminance deviation increases.

Figure 9:
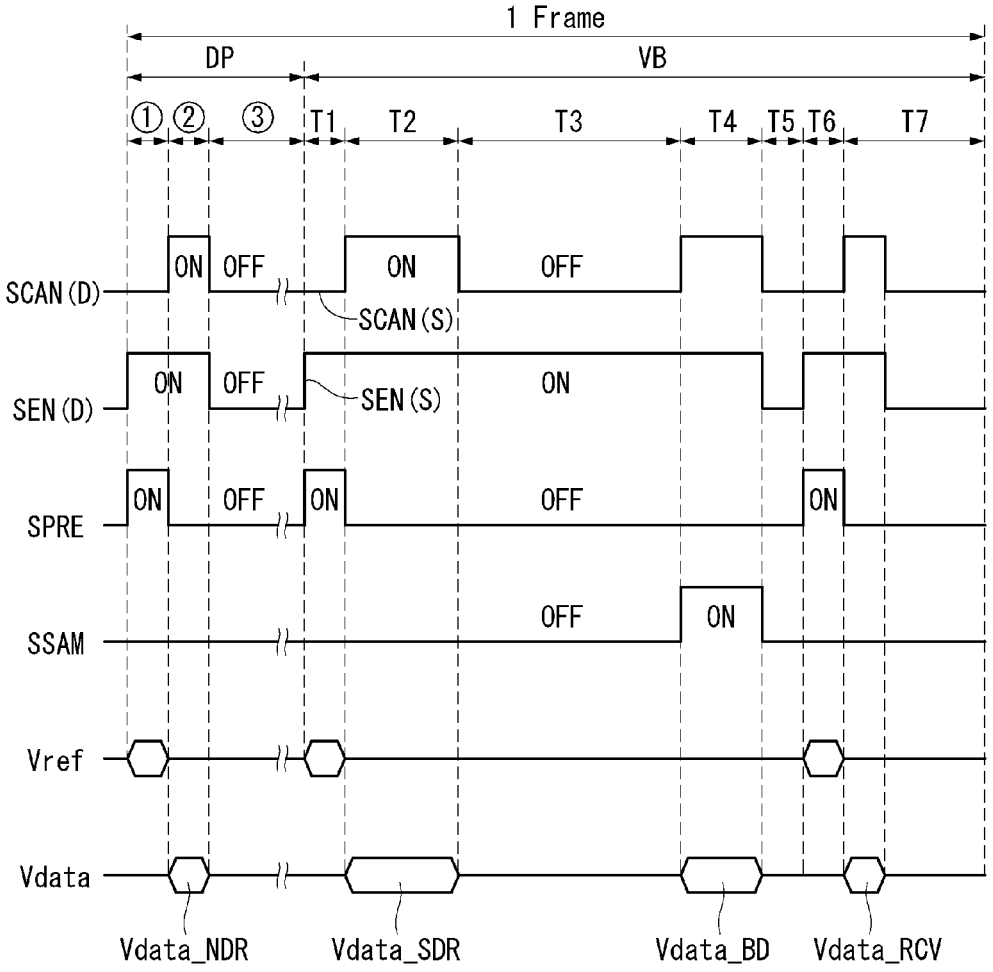
FIG. 9 shows a driving waveform according to an exemplary embodiment of the invention for reducing a luminance deviation between a display image and a recovery image.

As shown in FIG. 9, the embodiment of the invention proposes a method for supplying the image display gate pulse for charging the image display data voltage and the sensing gate pulse for charging the luminance recovery data voltage in the same shape, so as to minimize the luminance deviation between the sensing target display line and the non-sensing target display line.

As shown in FIG. 9, the shapes of the sensing gate pulses SCAN(S) and SEN(S) corresponding to the luminance recovery initialization period T5 and the luminance recovery programming period T6 are set to be the same as the shapes of the image display gate pulses SCAN(D) and SEN(D) corresponding to the image display initialization period ① and the image display programming period ②.

Figure 10:
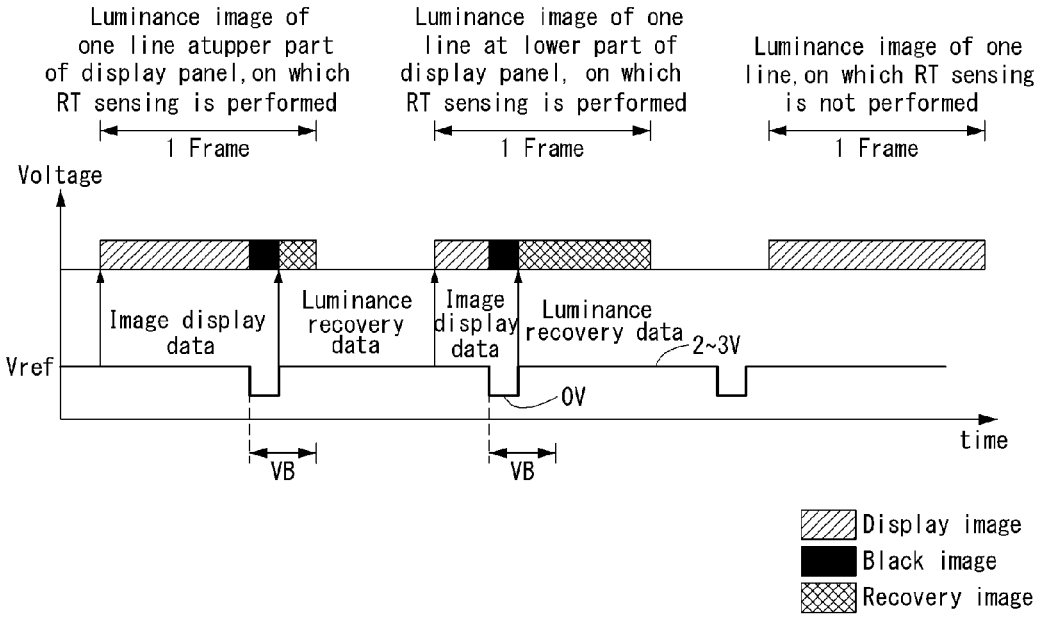
FIG. 10 shows an example of a reduction in a luminance deviation between a display image and a recovery image.

As described above, when the shapes of the sensing gate pulses and the shapes of the image display gate pulses are the same as each other, a saturation maintenance width of the first sensing gate pulse SCAN(S) is equal to a saturation maintenance width of the first image display gate pulse SCAN(D). Therefore, a charge amount C1 of the luminance recovery data voltage Vdata_RCV charged to the gate electrode of the driving TFT DT during the luminance recovery programming period T6 is the same as a charge amount C2 of the image display data voltage Vdata_NDR charged to the gate electrode of the driving TFT DT during the image display programming period ②. Thus, as shown in FIG. 10, a luminance amount of the recovery image resulting from the luminance recovery data voltage Vdata_RCV is the same as a luminance amount of the display image resulting from the image display data voltage Vdata_NDR. As a result, the luminance deviation between the sensing target display line and the non-sensing target display line during the same image frame is minimized.

As shown in FIGS. 6 and 9, an image display drive and a sensing drive according to the embodiment of the invention are sequentially described below.

The image display drive according to the embodiment of the invention may be performed through the image display initialization period ①, the image display programming period ②, and the image display emission period ③.

In the image display initialization period ①, the first switch TFT ST1 is turned off in response to the first image display gate pulse SCAN(D) of an off-level, and the second switch TFT ST2 is turned on in response to the second image display gate pulse SEN(D) of an on-level. Hence, the source voltage of the driving TFT DT is initialized to a previously determined reference voltage Vref.

In the image display programming period ②, the first and second switch TFTs ST1 and ST2 are turned on in response to the first and second image display gate pulses SCAN(D) and SEN(D) of the on-level. Hence, the image display data voltage Vdata_NDR is applied to the gate electrode of the driving TFT DT in an initialization state of the source voltage of the driving TFT DT and turns on the driving TFT DT.

In the image display emission period ③, the first and second switch TFTs ST1 and ST2 are turned off in response to the first and second image display gate pulses SCAN(D) and SEN(D) of the off-level. In this instance, the gate-source voltage of the driving TFT DT programmed in the image display programming period ② is stored in the storage capacitor Cst. An image display driving current flows in the driving TFT DT due to the gate-source voltage of the driving TFT DT maintained in the storage capacitor Cst, and the OLED emits light due to the image display driving current. Hence, the original image is displayed.

The sensing drive according to the embodiment of the invention may be performed through the sensing initialization period T1, the sensing programming period T2, the sensing period T3, the sampling period T4, the luminance recovery initialization period T5, the luminance recovery programming period T6, and the luminance recovery emission period T7.

In the sensing initialization period T1, the first switch TFT ST1 is turned off in response to the first sensing gate pulse SCAN(S) of an off-level, and the second switch TFT ST2 is turned on in response to the second sensing gate pulse SEN(S) of an on-level. Hence, the source voltage of the driving TFT DT is firstly initialized to a first reference voltage Vref, which is previously determined. In the embodiment disclosed herein, the first reference voltage Vref may be selected as a voltage less than the reference voltage Vref applied in the image display initialization period ①, so as to increase the sensing accuracy. For example, if the reference voltage Vref applied in the image display initialization period ① is 2V to 3V, the first reference voltage Vref may be zero.

In the sensing programming period T2, the first and second switch TFTs ST1 and ST2 are turned on in response to the first and second sensing gate pulses SCAN(S) and SEN(S) of the on-level. Hence, a sensing data voltage Vdata_SDR is applied to the gate electrode of the driving TFT DT in a first initialization state of the source voltage of the driving TFT DT and sets the driving TFT DT to a turn-on state.

In the sensing period T3, the first switch TFT ST1 is turned off in response to the first sensing gate pulse SCAN(S) of the off-level, and the second switch TFT ST2 is turned on in response to the second sensing gate pulse SEN(S) of the on-level. Hence, a current flows between the source electrode and the drain electrode of the driving TFT DT, and the source voltage of the driving TFT DT increased by the source-drain current of the driving TFT DT is sensed and stored.

In the sampling period T4, the first and second switch TFTs ST1 and ST2 are turned on in response to the first and second sensing gate pulses SCAN(S) and SEN(S) of the on-level. Hence, the sensed source voltage of the driving TFT DT is sampled and detected as the changes in the electrical characteristic of the driving TFT DT.

Further, in the sampling period T4, the black display data voltage capable of turning off the driving TFT DT is applied to the gate electrode of the driving TFT DT, and the unnecessary emission of the OLED during the sampling may be prevented.

The first sensing gate pulse SCAN(S) is maintained at the off-level and the second sensing gate pulse SEN(S) is maintained at the off-level and then is changed to the on-level during the luminance recovery initialization period T5, so that the sensing gate pulse is supplied in the same pulse shape as the image display gate pulse in a predetermined period for charging the luminance recovery data voltage.

In the luminance recovery initialization period T5, the first switch TFT ST1 is turned off in response to the first sensing gate pulse SCAN(S) of the off-level, and the second switch TFT ST2 is turned on in response to the second sensing gate pulse SEN(S) of the on-level. Hence, the source voltage of the driving TFT DT is secondly initialized to a second reference voltage Vref. In the embodiment disclosed herein, the second reference voltage Vref may be selected as a voltage level, i.e., 2V to 3V equal to the reference voltage Vref applied in the image display initialization period ①. This is to set the source voltage of the driving TFT DT in the image display initialization period ① to be equal to the source voltage of the driving TFT DT in the luminance recovery initialization period T5.

In the luminance recovery programming period T6, the first and second switch TFTs ST1 and ST2 are turned on in response to the first and second sensing gate pulses SCAN(S) and SEN(S) of the on-level. Hence, the luminance recovery data voltage Vdata_RCV is applied to the gate electrode of the driving TFT DT in a second initialization state of the source voltage of the driving TFT DT and turns on the driving TFT DT.

In the luminance recovery emission period T7, the first and second switch TFTs ST1 and ST2 are turned off in response to the first and second sensing gate pulses SCAN(S) and SEN(S) of the off-level. In this instance, the gate-source voltage of the driving TFT DT programmed in the luminance recovery programming period T6 is stored in the storage capacitor Cst. A luminance recovery driving current flows in the driving TFT DT due to the gate-source voltage of the driving TFT DT maintained in the storage capacitor Cst, and the OLED emits light due to the luminance recovery driving current. Hence, the luminance recovery image is displayed.

The embodiment of the invention reduces the luminance deviation between the sensing target display line and the non-sensing target display line by equally controlling the luminance amount of the recovery image and the luminance amount of the display image through the above-described configuration. However, even in the above-described configuration, because the sensing target display line has to display the black image during the sampling period T4, the luminance of the sensing target display line is less than the luminance of the non-sensing target display line.

Figure 11:
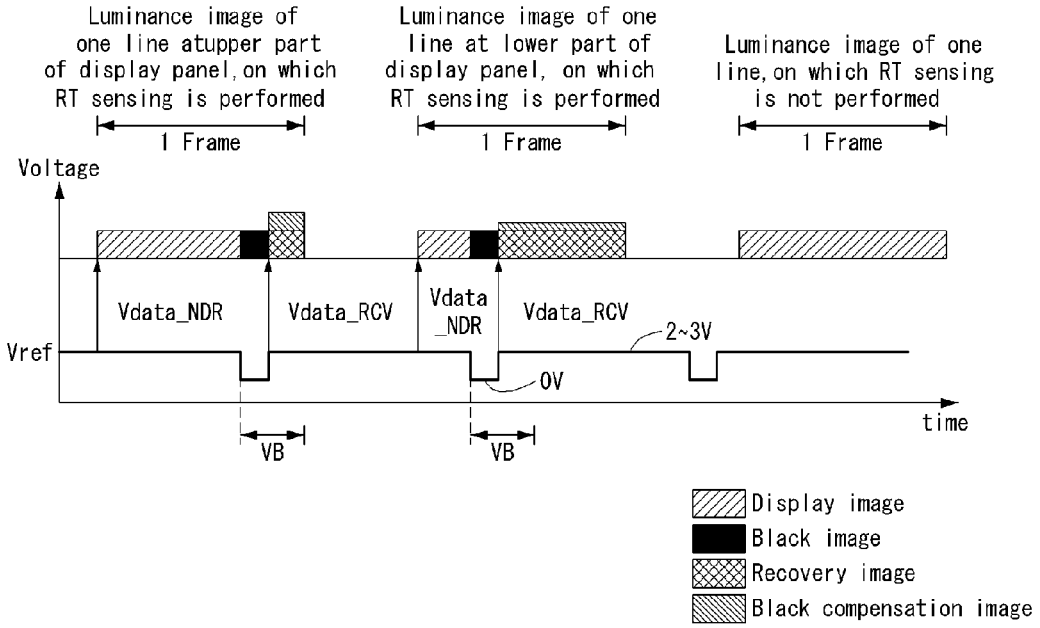
FIG. 11 illustrate a method for compensating for a luminance reduction generated by a black image to minimize a luminance deviation between a sensing target display line and a non-sensing target display line.

Hence, as shown in FIG. 11, the embodiment of the invention modulates the luminance recovery digital data to be applied to the sensing target display line during the vertical blank period VB through the timing controller 11 and compensates for the luminance reduction generated by the black image, so as to compensate for the luminance deviation between the sensing target display line and the non-sensing target display line.

Figure 12:
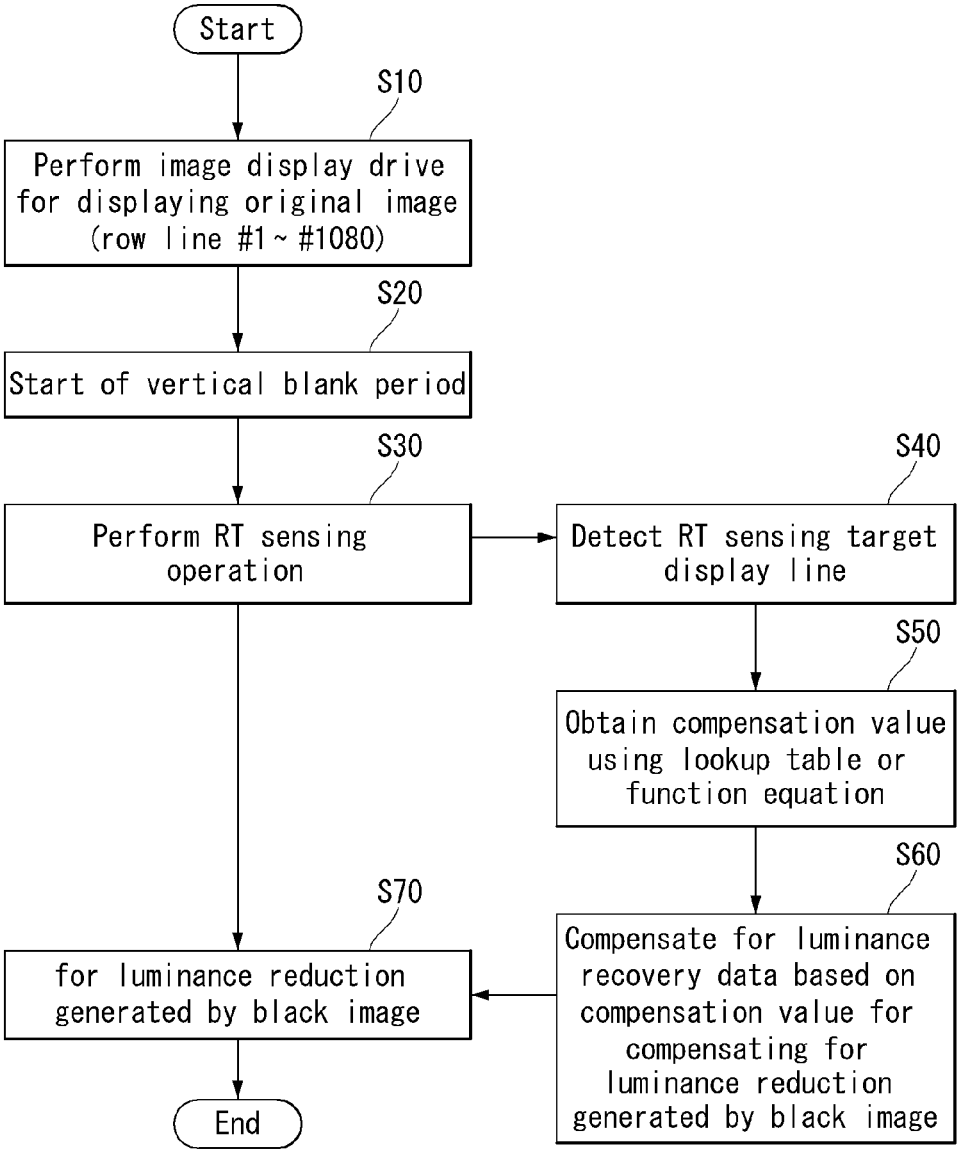
FIG. 12 is a flow chart showing operation order of a timing controller for compensating for a luminance reduction generated by a black image.

More specifically, as shown in FIG. 12, the timing controller 11 sequentially performs an image display drive for displaying an original image on all of the display lines of the display panel in an image display period DP of one frame in step S10.

When the image display drive is completed and a vertical blank period VB of the one frame starts in step S20, the timing controller 11 performs an RT sensing operation in step S30.

The timing controller 11 decides how many frames there are before the one frame based on a frame count operation and detects a sensing target display line, on which the RT sensing is performed in the vertical blank period VB of the one frame, based on the result of a decision in step S40.

The timing controller 11 obtains a compensation value which compensates for a luminance reduction generated by a black image and is suitable for a location of the detected sensing target display line. For this, the timing controller 11 may use a lookup table, in which the compensation values are previously stored depending on each location of the sensing target display line, or may directly obtain the compensation value from a function equation of the compensation values depending on each location of the sensing target display line in step S50.

The timing controller 11 outputs luminance recovery data compensated based on the obtained compensation value and may further reduce a luminance deviation between the sensing target display line and non-sensing target display lines.

Figure 13:
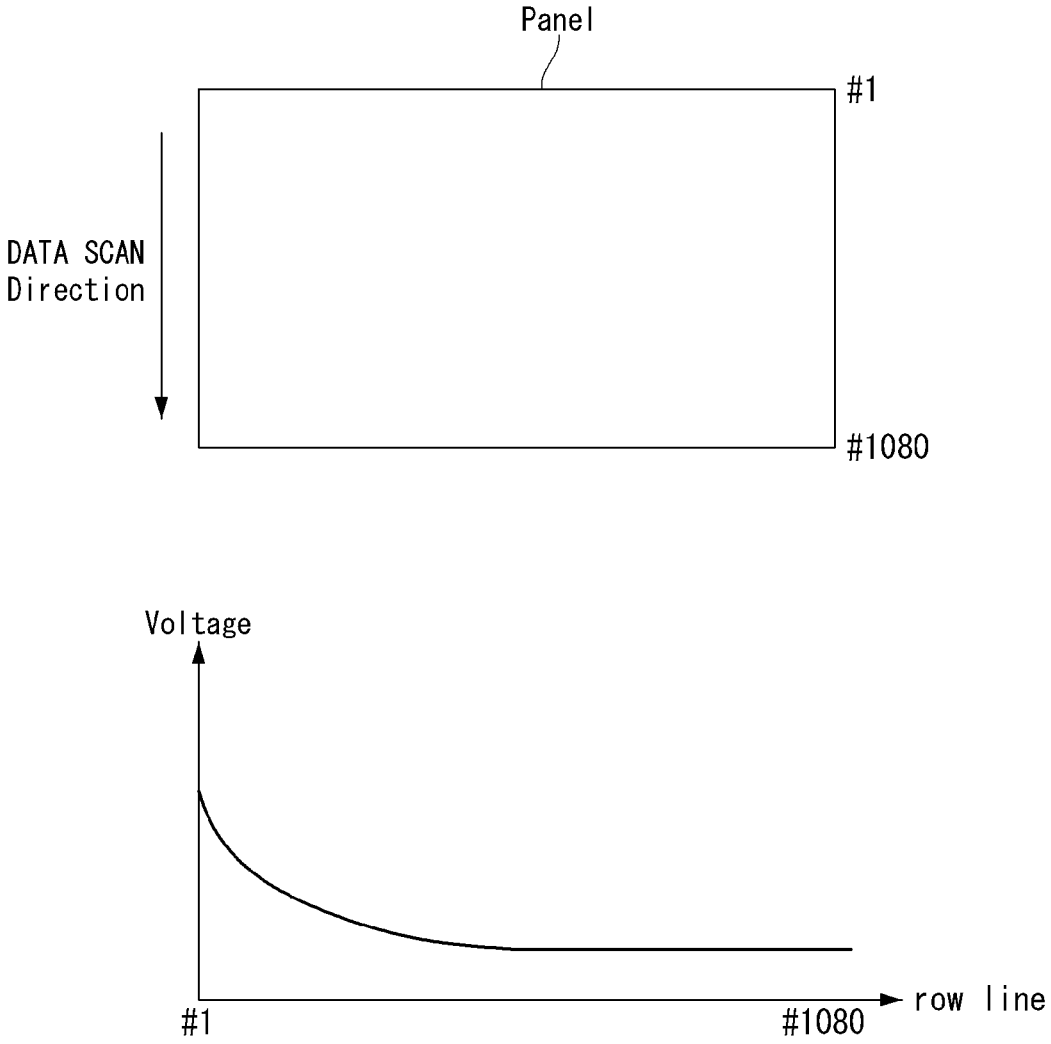
FIG. 13 shows an example where a compensation value for compensating for a luminance reduction generated by a black image varies depending on a location of a sensing target display line.

The compensation value for modulating the luminance recovery data through the timing controller 11 varies depending on the location of the sensing target display line. Namely, as shown in FIG. 13, the compensation value for modulating the luminance recovery data may gradually decrease as the sensing target display line goes from one side (for example, row line #1) of the display panel, to which data is firstly applied, to the other side (for example, row line #1080) of the display panel, to which the data is last applied. In other words, the compensation value for modulating the luminance recovery data may gradually decrease as a display duty of a recovery image increases.

As described above, the embodiment of the invention supplies the sensing gate pulse in the same pulse shape as the image display gate pulse in a predetermined period for charging the luminance recovery data voltage when changes in the electrical characteristic of the driving TFT of the pixels of only one display line are sensed and compensated in the vertical blank period through the external compensation method, thereby reducing the luminance deviation between the sensing target display line and the non-sensing target display line.

Furthermore, the embodiment of the invention compensates for the luminance reduction generated by the black image by modulating the luminance recovery data and differently obtains the compensation value for modulating the luminance recovery data depending on the location of the sensing target display line, thereby further reducing the luminance deviation between the sensing target display line and the non-sensing target display line.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel including display lines, on which a plurality of pixels each including an organic light emitting diode and a driving thin film transistor (TFT) are formed, the display lines being sequentially charged to an image display data voltage in response to an image display gate pulse in an image display period of one frame, a sensing target display line among the display lines outputting a sensing voltage corresponding to changes in electrical characteristic of the driving TFT included in each pixel in response to a sensing gate pulse during a vertical blank period excluding the image display period from the one frame and then being charged to a luminance recovery data voltage;

a gate driving circuit configured to sequentially supply the image display gate pulse to gate lines connected to the pixels of the display lines during the image display period and supply the sensing gate pulse to a gate line connected to the pixels of the sensing target display line during the vertical blank period; and a data driving circuit configured to supply the image display data voltage to data voltage supply lines connected to the pixels of the display lines in synchronization with the image display gate pulse and supply the luminance recovery data voltage to data voltage supply lines connected to the pixels of the sensing target display line in synchronization with the sensing gate pulse, wherein the sensing gate pulse is supplied in the same pulse shape as the image display gate pulse in a predetermined period for charging the luminance recovery data voltage.

2. The organic light emitting display of claim 1, wherein each pixel includes:

the driving TFT including a gate electrode connected to a first node, a source electrode connected to a second node, and a drain electrode connected to an input terminal of a high potential driving voltage;

the organic light emitting diode connected between the second node and an input terminal of a low potential driving voltage;

a storage capacitor connected between the first node and the second node;

a first switch TFT connected between one of the data voltage supply lines and the first node; and a second switch TFT connected between a reference line, to which the sensing voltage is output, and the second node.

3. The organic light emitting display of claim 2, wherein the image display gate pulse includes a first image display gate pulse for turning on the first switch TFT in the image display period and a second image display gate pulse for turning on the second switch TFT in the image display period, wherein the sensing gate pulse includes a first sensing gate pulse for turning on the first switch TFT in the vertical blank period and a second sensing gate pulse for turning on the second switch TFT in the vertical blank period.

4. The organic light emitting display of claim 3, wherein the image display period includes:

an image display initialization period, in which a source voltage of the driving TFT is initialized to a previously determined reference voltage in response to the first image display gate pulse of an off-level and the second image display gate pulse of an on-level;

an image display programming period, in which the image display data voltage is applied to the gate electrode of the driving TFT in response to the first and second image display gate pulses of the on-level in the initialization state of the source voltage of the driving TFT and turns on the driving TFT; and an image display emission period, in which the organic light emitting diode operates using an image display driving current applied through the driving TFT in response to the first and second image display gate pulses of the off-level and displays an original image.

5. The organic light emitting display of claim 3, wherein the vertical blank period includes:

a sensing initialization period, in which a source voltage of the driving TFT is firstly initialized to a first reference voltage, which is previously determined, in response to the first sensing gate pulse of an off-level and the second sensing gate pulse of an on-level;

a sensing programming period, in which a sensing data voltage is applied to the gate electrode of the driving TFT in response to the first and second sensing gate pulses of the on-level in the first initialization state of the source voltage of the driving TFT and sets the driving TFT to a turn-on state;

a sensing period, in which the source voltage of the driving TFT increased by a current flowing in the driving TFT is sensed and stored in response to the first sensing gate pulse of the off-level and the second sensing gate pulse of the on-level;

a sampling period, in which the sensed source voltage of the driving TFT is sampled and detected as the changes in the electrical characteristic of the driving TFT in response to the first and second sensing gate pulses of the on-level;

a luminance recovery initialization period, in which the source voltage of the driving TFT is secondly initialized to a second reference voltage in response to the first sensing gate pulse of the off-level and the second sensing gate pulse of the on-level;

a luminance recovery programming period, in which the luminance recovery data voltage is applied to the gate electrode of the driving TFT in response to the first and second sensing gate pulses of the on-level in the second initialization state of the source voltage of the driving TFT and turns on the driving TFT; and a luminance recovery emission period, in which the organic light emitting diode operates using a luminance recovery driving current applied through the driving TFT in response to the first and second sensing gate pulses of the off-level and displays a luminance recovery image.

6. The organic light emitting display of claim 5, wherein during the luminance recovery initialization period, the first sensing gate pulse is maintained at the off-level, and the second sensing gate pulse is maintained at the off-level and then is changed to the on-level.

7. The organic light emitting display of claim 5, wherein the first reference voltage is less than the second reference voltage.

8. The organic light emitting display of claim 5, wherein a black display data voltage capable of turning off the driving TFT is applied to the gate electrode of the driving TFT during the sampling period.

9. The organic light emitting display of claim 1, wherein the luminance recovery data voltage has the same voltage level as the image display data voltage applied to the sensing target display line during the image display period.

10. The organic light emitting display of claim 9, further comprising a timing controller configured to control an operation of the gate driving circuit and an operation of the data driving circuit, modulate image display digital data to be applied to the display lines during the image display period to compensate for the changes in the electrical characteristic of the driving TFT, and modulate luminance recovery digital data to be applied to the sensing target display line during the vertical blank period to compensate for a luminance deviation between the sensing target display line and another display line, wherein the image display digital data corresponds to the image display data voltage, and the luminance recovery digital data corresponds to the luminance recovery data voltage.

11. The organic light emitting display of claim 10, wherein a compensation value for modulating the luminance recovery digital data varies depending on a location of the sensing target display line.

12. The organic light emitting display of claim 11, wherein the compensation value for modulating the luminance recovery digital data gradually decreases as the sensing target display line goes from one side of the display panel, to which data is firstly applied, to the other side of the display panel, to which the data is last applied.

13. The organic light emitting display of claim 1, wherein the change in the electrical characteristic of the driving TFT indicates at least one of change in a threshold voltage of the driving TFT and change in a mobility of the driving TFT.

* * * * *